United States Patent [19]

Bowyer

[11] Patent Number: 4,478,288

[45] Date of Patent: Oct. 23, 1984

[54] APPARATUS WITH ANNULUS SAFETY VALVE FOR THROUGH TUBING INJECTION AND METHOD OF USE

[75] Inventor: Michael L. Bowyer, Aberdeen, Scotland

[73] Assignee: Baker International Corporation, Orange, Calif.

[21] Appl. No.: 307,835

[22] Filed: Oct. 2, 1981

[51] Int. Cl.[3] ..... E21B 43/00; E21B 34/10

[52] U.S. Cl. ..... 166/372; 166/375; 166/85; 166/322; 166/242

[58] Field of Search ..... 166/72, 85, 86, 183, 166/242, 319, 320, 321, 322, 372, 374, 375, 383, 386

[56] References Cited

U.S. PATENT DOCUMENTS

| | | | |
|---|---|---|---|
| 3,434,535 | 3/1969 | Page | 166/72 |
| 3,937,280 | 2/1976 | Dinning | 166/242 |
| 3,990,511 | 11/1976 | Gazda | 166/322 |
| 4,022,273 | 5/1977 | Marathe | 166/322 |
| 4,031,955 | 6/1977 | Ledet | 166/183 |
| 4,049,052 | 9/1977 | Arendt | 166/183 |
| 4,249,599 | 2/1981 | Krause | 166/72 |
| 4,271,903 | 6/1981 | Slagle, Jr. et al. | 166/183 |

*Primary Examiner*—Stephen J. Novosad
*Assistant Examiner*—William P. Neuder
*Attorney, Agent, or Firm*—Norvell & Associates

[57] ABSTRACT

An assembly including a tubing safety valve and annulus safety valve mounted within nipples incorporated within an inner conduit is disclosed for use in conjunction with the injection of material, such as gas, through the center of the inner conduit. The injected material can be used to stimulate production of fluids from the formation through the annulus between the inner conduit and an outer concentric conduit. This outer concentric conduit normally comprises an existing producting tubing string having existing safety valve nipple and external control fluid lines. Nipples incorporated within the inner conduit provide means for sealing the annulus between the inner and the outer conduit and for positioning the inner conduit relative to the outer conduit to provide communication between the tubing safety valve and the annulus safety valve and the external existing source of control fluid pressure. Bypass ports above and below on opposite sides of the annulus seals extend through the nipple members and an axially reciprocal annulus safety valve mandrel is moved from a position closing at least one of the bypass ports to an open position when subjected to control line pressure. Both the tubing safety valve and the annulus safety valve are activated when subjected to a common source of control line pressure.

15 Claims, 10 Drawing Figures

APPARATUS WITH ANNULUS SAFETY VALVE FOR THROUGH TUBING INJECTION AND METHOD OF USE

BACKGROUND OF THE INVENTION

1. Field of the Invention

This invention relates to safety systems for controlling subterranean wells, more particularly to safety valve assemblies for controlling the flow in a subterranean well comprising concentric inner and outer conduits with safety valves being operable to prevent flow through the inner tubing and through the annulus between inner and outer concentric tubing members.

2. Description of the Prior Art

In subterranean oil and gas wells, the reservoir pressure is often sufficient to cause produced petroleum fluids to flow naturally to the surface of the well. In other wells, the pressure is initially insufficient to permit production of fluids in this manner or the pressure becomes insufficient after some period of continued operation. It then becomes necessary to provide some means to artificially stimulate production of the wells. One means of furnishing such artificial stimulation is through artificial gas lift techniques. Gas may be continuously injected from the surface of the well to the formation or it may be intermittently injected to lift produced fluids to the surface of the well. When artificial gas lift is necessary, it is standard practice to install conventional gas lift control mandrels, injection mandrels and conventional gas lift valves in the oil well. Where production from the well has previously relied upon the natural reservoir pressure, it has heretofore been standard practice to pull the existing production tubing string and install conventional gas lift control mandrels, injection mandrels, and gas lift valves in order to produce by artificial stimulation means. This practice necessitates the complete removal of the existing production string, however. In addition to the complete reworking of the existing production string, there are other methods of artificially stimulating a well to provide artificial gas lift. One example would be to use a macaroni string tubing inserted into the existing tubing. Gas inserted through this macaroni tubing would be conveyed to the formation and would provide a means for producing fluid through the annulus between the inner tubing and the outer production tubing.

Through tubing injection with annulus production, even with the addition of an inner tubing member, still requires the use of appropriate safety valves to prevent unrestricted flow through the tubing in the annulus in case of some catastrophe. The present invention contemplates the use of a conventional safety valve to restrict flow through the inner conduit. However, in addition to preventing flow through the inner conduit, it is also necessary to prevent flow along the normal production path in the annulus between the inner and outer conduits. An annulus safety valve must be employed to prevent flow in this manner. Conventional wireline retrievable annular safety valves for providing fail-safe closure for wells in which annulus flow is required are shown on pages 778–781 of the 1980–1981 edition of the Composite Catalog of Oil Field Equipment & Services published by World Oil. These conventional annulus safety valves are generally used to provide a fail-safe seal in the annulus between the production tubing and the outer casing in a conventional well. These annulus safety valves generally employ an axially movable sleeve member which moves to open a port extending radially through the sides of the nipples when subjected to control line pressure. Other annulus safety valves are shown on pages 5383–5387 of the 1978–1979 Composite Catalog of Oil Field Equipment & Services. An axially movable piston member which moves when subjected to hydraulic control line pressure has also been employed to open and close radially extending ports in at least one of the annulus type safety valves depicted therein.

SUMMARY OF THE INVENTION

The surface control safety valve apparatus used in the preferred embodiment of this invention to control the flow in an inner conduit and in the annulus between the inner conduit and the outer conduit comprises a tubing safety valve and an annulus safety valve in combination with nipple assemblies incorporated on the inner conduit for positioning the tubing in annulus safety valves. In the preferred embodiment of this invention the inner conduit comprises a workover string having the nipple assemblies incorporated in the workover string and in which positioning means are incorporated in the nipple assemblies to locate the workover string at the proper position relative to the existing outer conduit, or production string. A common control line extends between the tubing and annulus safety valve, and both valves move to open the tubing and the annulus when subjected to control pressure from a common external source. A nipple assembly incorporable in the inner conduit has seals on the exterior thereof to provide sealing integrity between the inner and outer conduit and has control fluid passages for establishing communication with the external source of control fluid located at some point on the existing outer conduit. Bypass ports are located in the nipple assembly on opposite sides of the seals between the nipple assembly and the outer conduit. An axially reciprocal valve, which is open when subjected to control line pressure, can then move from a position closing at least one of the ports to a position in which flow through ports above and below the annulus seals will allow production through the annulus between the inner and outer conduit. An efficient means of providing artificial gas lift by the injection of gas through the inner tubing, or of injecting any other material through the tubing to the formation therebelow with subsequent production occurring through the annulus, is therefore provided with necessary tubing and annulus safety valves being installed above the formation.

DESCRIPTION OF THE PREFERRED EMBODIMENT

Figure 1A:
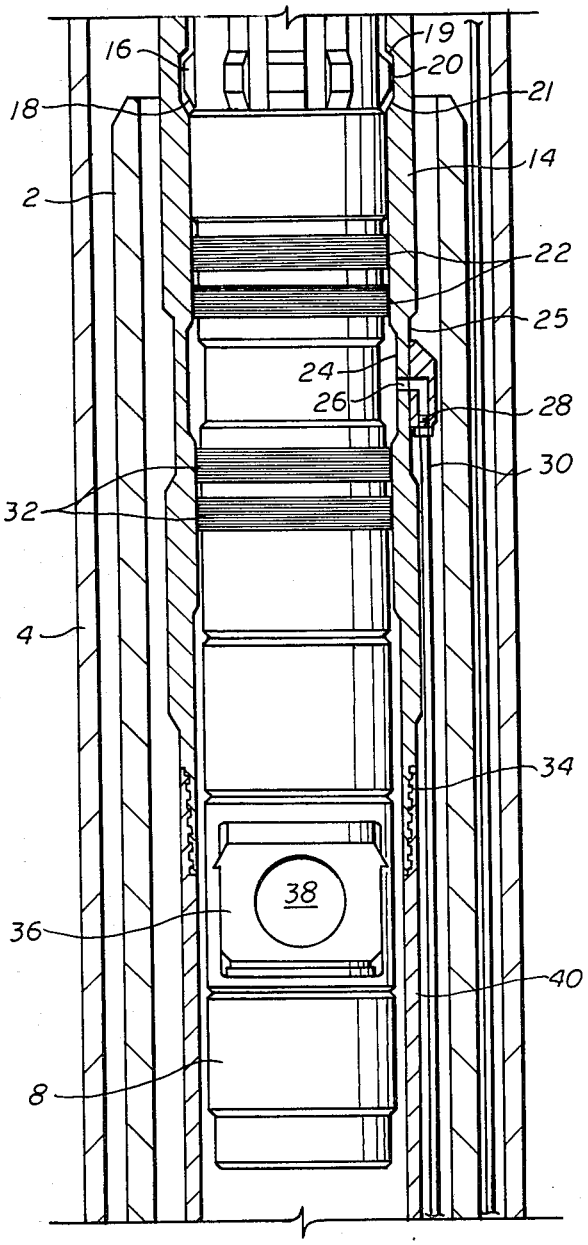
FIGS. 1A through 1D depict a tubing mounted assembly utilizing a tubing safety valve, a landing nipple, and an annular safety valve.

The assembly depicted in FIG. 1 comprises a conventional production tubing string 2 and a workover tubing string 6, each contained within a standard oil well casing 4. The preferred embodiment of this invention is used with a secondary or workover tubing string 6 which is inserted within the existing outer tubing string 2 to allow the injection of a fluid or the injection of gas through the inner workover tubing string 6 to the formation below. Injection through the tubing is designed to promote the production of fluids from the formation up through the annulus between workover string or inner conduit 6 and the production tubing or outer conduit 2. In the preferred embodiment of this invention, a ported nipple assembly 12 is incorporated within the workover tubing string 6. An annulus safety valve 10 can then be inserted within workover tubing string 6 to control the flow of produced fluids through the annulus between workover tubing string 6 and the production tubing 2. A conventional tubing safety valve 8 can also be positioned in the workover tubing string 6 in a conventional manner to control or prevent the flow of produced fluids through the central fluid passage of tubing 6. Both the tubing safety valve 8 and the annulus safety valve 10 are controlled from the surface by means of control pressure. Should this supply of control fluid pressure be interrupted, both safety valves will close, shutting off flow in the inner conduit 6 and in the annulus between conduits 6 and 2. In this way, the well may be shut off in the event of damage at the surface which severs the existing external control lines.

Before describing the workover tubing string 6 or the valves 8 and 10, the features of the production tubing 2 which permit use of the workover string and its associated valves will be described. The assembly of the preferred embodiment of this invention utilizes standard control lines and nipples already positioned within or on the existing production tubing 2. A workover string 6 can then be snubbed within production tubing 2 to allow workover of the existing well, such as the addition of a gas lift capability while employing the control lines in the original production string. This workover string may be inserted into a production string 2 containing a conventional nipple 130, as shown in FIG. 1D. Nipple 130 is connected within production string 2 by means of a threaded connection 116 at its upper end and a lower threaded connection 152. Nipple 130 has an annular groove 120 below threaded connection 116 and an upwardly facing shoulder, commonly referred to as a no-go shoulder, 124 which forms a local restriction in the bore of production tubing 2. Nipple 130 has a second annular recess 136 positioned below no-go shoulder 124. A cylindrical radially extending port 134 extends through the nipple in this annular recess 136. On the exterior of nipple 130 at the location of port 134, a conventional control line connection is attached to the exterior of the tubing. Control line connection 132 is provided with an internal passage communicating with port 134 and control line 128. Control line connection 132 provides conventional means for attaching an exterior control line 128 which extends to the surface of the well and provides an external source of control fluid pressure.

The workover production string 6 inserted within existing production string 2 of course has a smaller outer diameter than the inner diameter of the existing production string. The nipple assembly incorporated into the inner or workover string 6 does, however, include a downwardly facing no-go shoulder 122 extending radially beyond upwardly facing no-go shoulder 124 on production string 2. The abutment between upwardly facing no-go shoulder 124 and downwardly facing no-go shoulder 122 serves to position the workover string 6 relative to the existing production string 2. The safety valve subassembly comprises a tubing safety valve 8 and an annulus safety valve 10, both of which can be positioned within conduit forming workover tubing string 6. In order to permit insertion of tubing safety valve 8 and annulus safety valve 10 within workover string 6, appropriate nipples must be incorporated within tubing string 6. In the preferred embodiment, a series of these nipples or mounting members are incorporated into workover string 6. As shown in FIGS. 1A through 1D, this series of nipples comprise, in axially descending order; an upper standard nipple 14, an adjoining space-out flow coupling 40, a next adjacent landing nipple 52, a ported nipple 101 attached to an eccentric nipple 138, and finally a seal nipple 156. These downwardly descending nipples are each attached to the adjacent member by means of appropriate and conventional threaded connections. With this series of nipples incorporated into the workover string 6, the annulus safety valve 10, as shown separately in FIG. 2, can then be inserted within workover string 6. A conventional tubing safety valve 8 can also be positioned within workover string 6 above annulus safety valve 10.

Figure 2A:
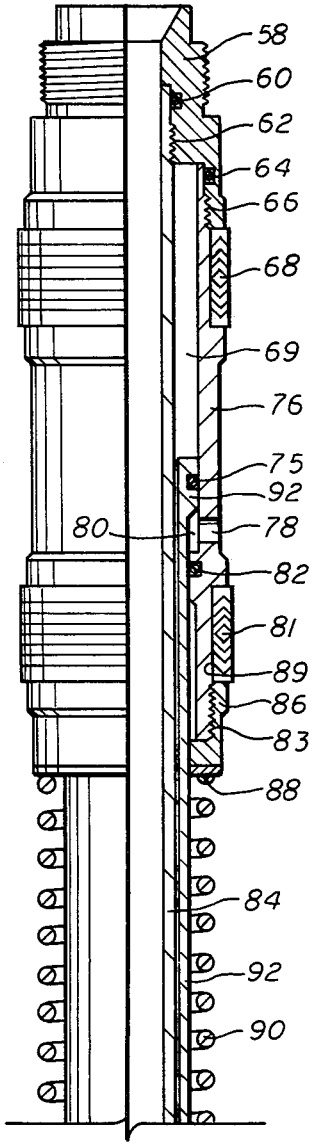
FIG. 2 depicts an annulus safety valve employed in the assembly shown in FIG. 1.
Figure 2B:
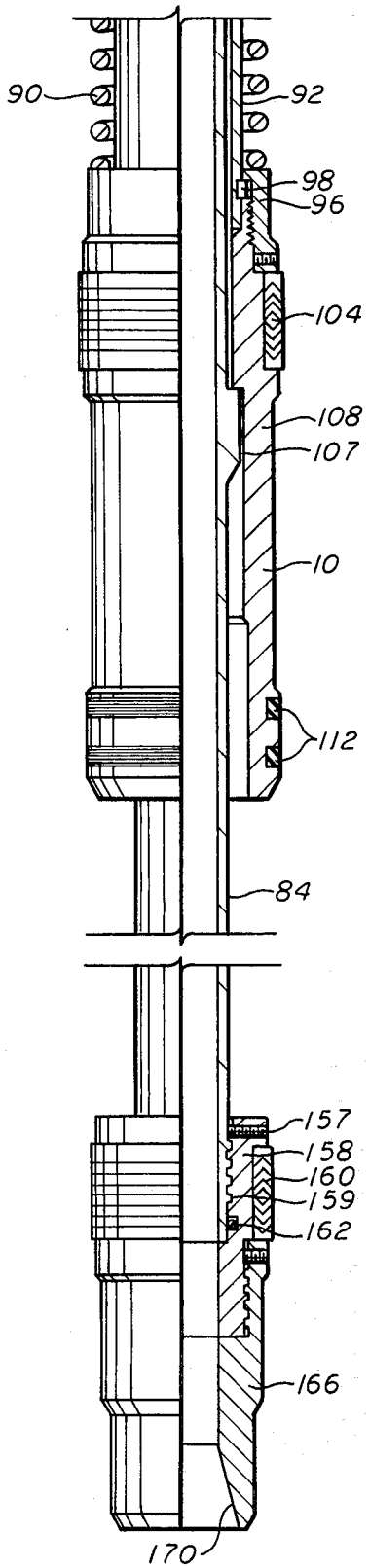
Figure 3A:
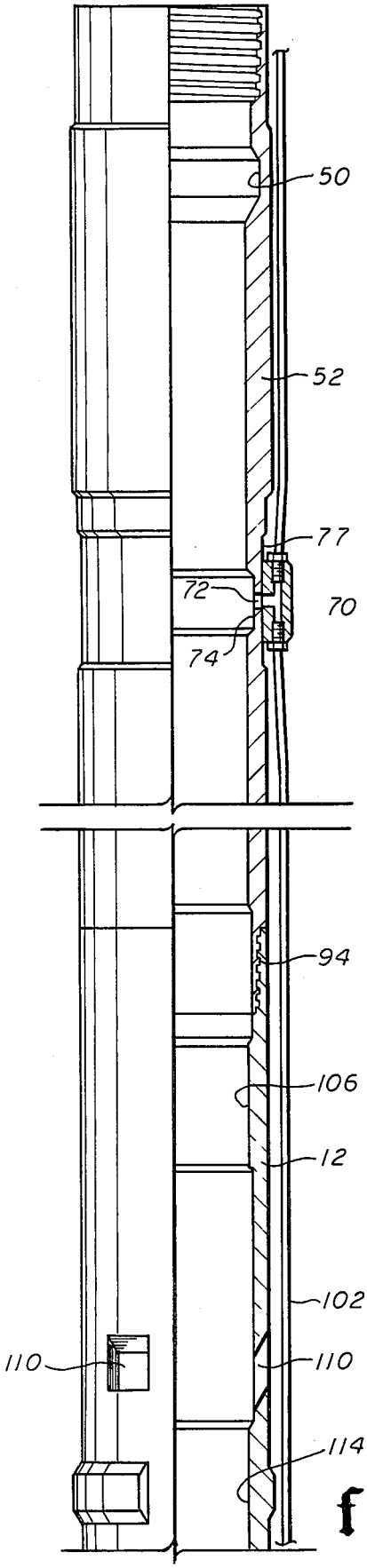
FIG. 3 depicts an eccentric ported seal nipple subassembly used in the assembly shown in FIG. 1.
Figure 3B:
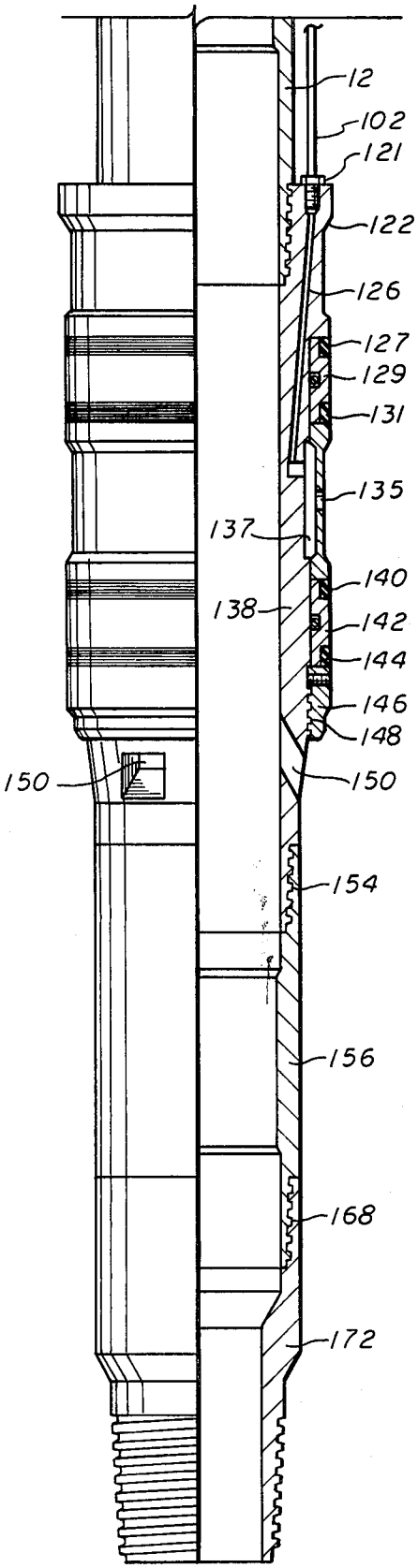
Figure 5:
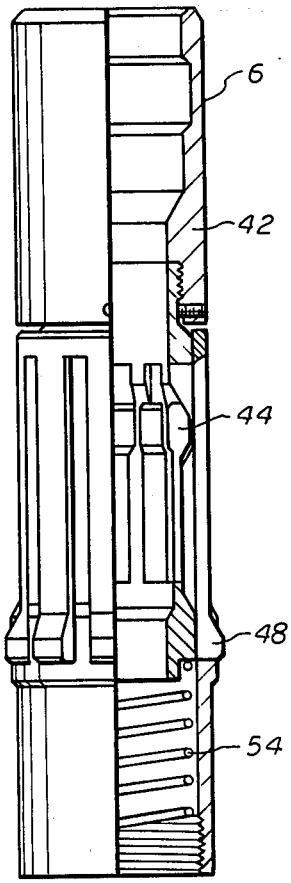
FIG. 5 depicts a lock employed in the assembly of FIG. 1.

The safety valve assembly is shown in FIGS. 1A through 1D. The principal components of this assembled configuration are shown individually in FIGS. 2, 3 and 5. Detailed comparison of the components, shown in FIGS. 2, 3 and 5 will reveal some minor discrepancies. These discrepancies result primarily from the need to simplify individual components in order to more conveniently show the assembled configuration of FIGS. 1A through 1D. Where the construction of an individual component, as shown in FIGS. 2, 3 or 5, differs from that component as shown in FIGS. 1A through 1D, it should be remembered that the preferred embodiment of this invention utilizes the component as shown in FIGS. 2, 3 or 5. These minor differences are not, however, significant in terms of the scope of this invention and, insofar as the invention is described and claimed, these differences and detailed construction are irrelevant. The detailed construction of the components of the preferred embodiment of this invention will be described by first describing the nipple members incorporated into workover string 6. After the description of the construction of these nipple members is complete, the safety valves mounted within these nipples will then be described. Thereafter, the operation of the entire safety valve assembly will be described.

The uppermost component incorporated into workover tubing string 6 at the location of the valve assemblies is a conventional nipple member 14 with a downward facing control inlet. This nipple member has two internal annular recesses extending outwardly from the inner bore thereof. The first internal recess or groove 20 has inwardly inclined surfaces 19 and 21 at the upper and lower end. This recess 20 is a conventional locking recess in which a radially expandable latching member can engage nipple 14. A second annular recess or groove 24 is located below recess 20. Recess 24 has a radially extending control port 26 extending from the interior to the exterior of nipple member 14. Internal recess 24 is axially positioned adjacent to a corresponding external recess 25. A conventional control line connecting member 28 is mounted within external recess 25 on nipple 14. A downwardly extending common control line 30 is attached to the lower end of control line connection 28. This control line extends along the exterior of the nipple assembly incorporated into workover string 6 and between workover string 6 and production tubing 2. A conventional threaded connection 34 between nipple 14 and space-out flow coupling member 40 is located at the lower end of nipple 14. Space-out flow coupling 40 is merely a tubular member extending between nipple 14 and landing nipple 52 and provides adequate space for subsequent insertion of both tubing safety valve 8 and annulus safety valve 10.

Figure 1B:
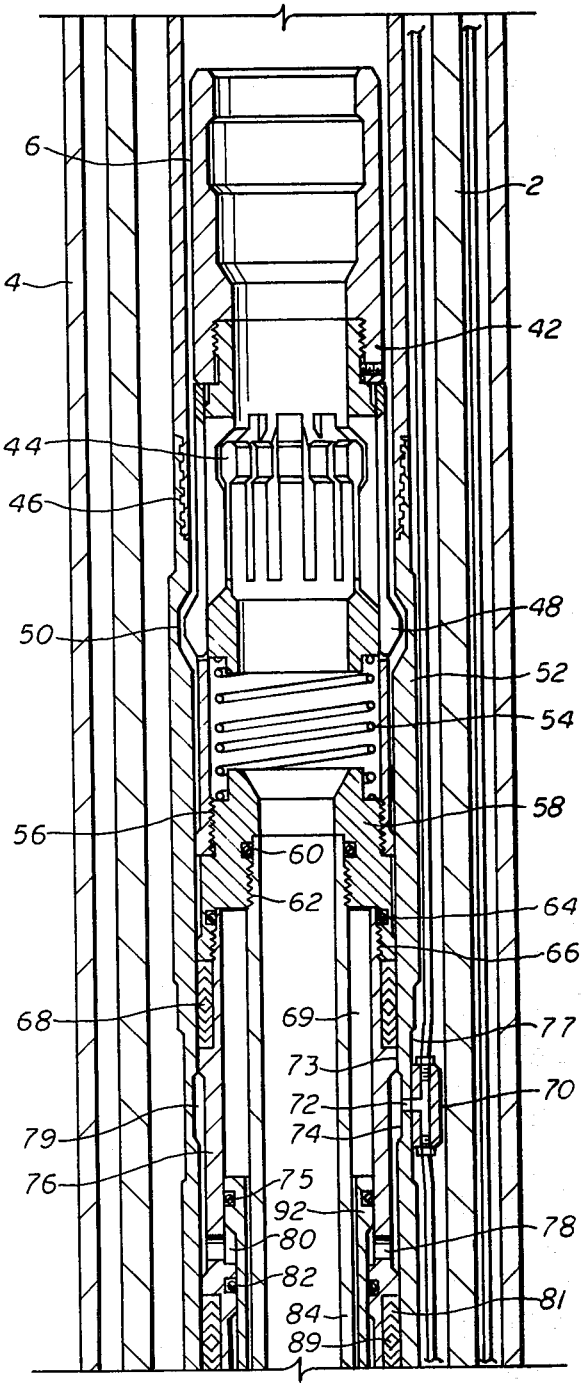
Figure 1C:
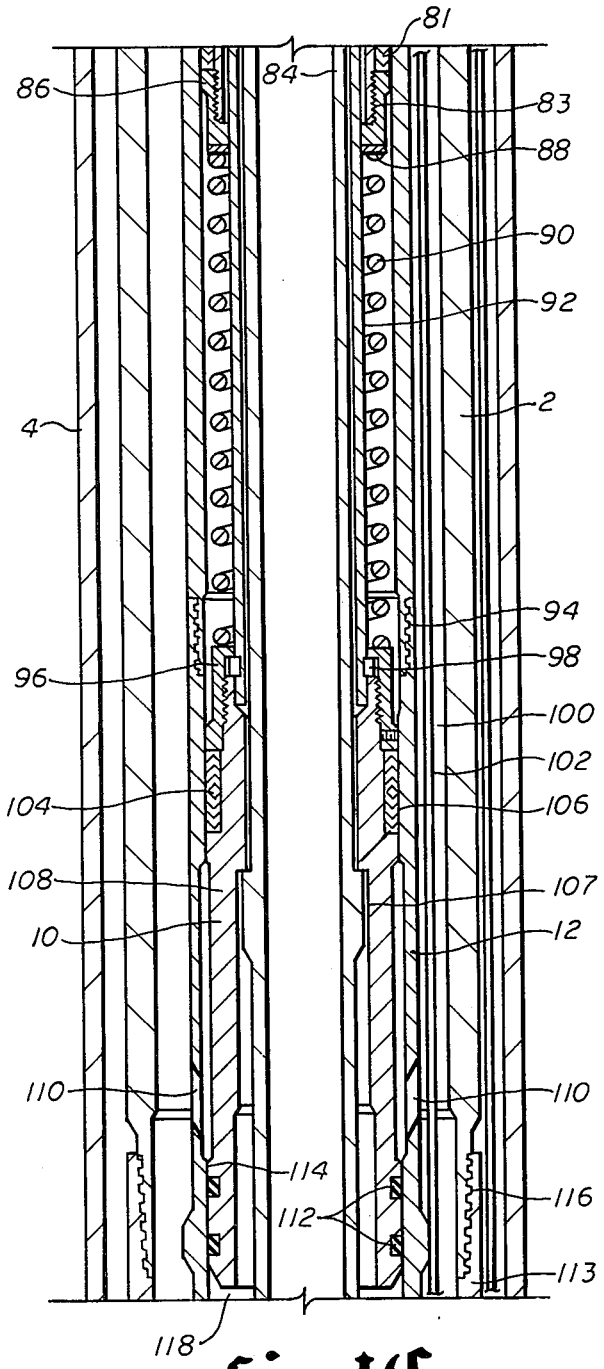
Figure 1D:
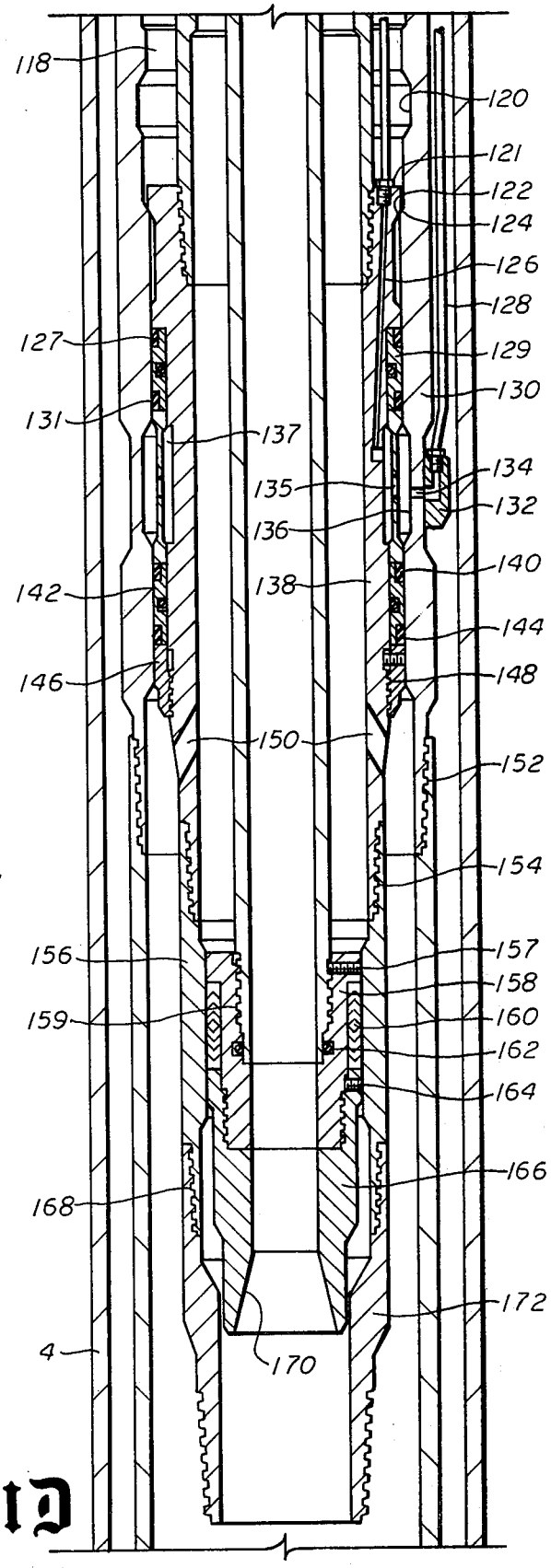

An annulus safety valve ported nipple assembly 12, shown in FIGS. 1B through 1D, and in FIG. 3, extends from space-out flow coupling 40 to the lower portion of workover string 6. This annulus safety valve ported nipple assembly consists of an uppermost landing nipple 52, a ported nipple 101, an eccentric nipple 138, and a lower seal nipple 156. The threaded connection 46 between flow coupling 40 and the nipple assembly 12 is located at the upper end of landing nipple 52. Immediately below this threaded connection is an internal recess or groove 50 located on the interior of landing nipple 52. Recess 50 is, in most respects, similar to the upper groove 20 in nipple 14. Both grooves are adapted to be engaged with a radially expanding member located on a component inserted within the nipple assembly by conventional wireline techniques. A second internal annular landing nipple recess 74 is located below recess 70. This recess 74 is, in many respects, similar to the upper recess 24 on nipple 14. Recess 74 also has a radially extending control port 72 extending from the interior to the exterior of the landing nipple member 52. An exterior recess 77 is also located at the same axial position as internal recess 74 with port 72 extending across landing nipple 52 between the internal and external recesses. A second control connection member 70 is positioned in external recess 77 in communication with port 72. This control connection member 70 has connections at its upper and lower ends to permit control line 30 to communicate with port 72 while also permitting communication between the control line above and below control block 70. Seal bore surfaces 73 and 89 are located along the inner surface of landing nipple 52 both above and below port 72.

A conventional threaded connection 94 is located at the lower end of landing nipple 52 and connects landing nipple 52 with ported nipple 101 extending therebelow. A seal bore surface 106 cooperable with seals 104 is located on the interior surface of ported nipple 101 between threaded connection 94 and a first flow port or ports 110. Flow port 110 has a substantially larger diameter than the control ports 72 and 26 located in the nipple members extending thereabove. A second seal bore surface 114 is located just below port 110. Ported nipple 101 is joined to eccentric nipple 138 by a conventional threaded connection 116. A control line coupling 121 is located along the upper end of eccentric nipple 138 on the exterior of threaded connection 119. This coupling connection 121 joins control line 30. An internal control fluid passage 126 extends inwardly from coupling 120. On the exterior of eccentric nipple 138 is a downwardly facing no-go positioning shoulder 122. This no-go shoulder represents the outermost radial extension of the nipple assemblies incorporated within workover string 6. Immediately below no-go shoulder 122 on eccentric nipple 138 is a longitudinally extending recess adapted to receive outwardly facing upper and lower or first and second seal assemblies 129 and 142. Seal assembly 129 contains first and second bonded seal elements 127 and 131. Seal assembly 142 similarly contains bonded seal members 140 and 144. A seal spacer 133 extends between upper seal assembly 129 and lower seal assembly 142. This seal spacer 133 has a centrally located radially extending port 135. Radially extending port 135 communicates with a longitudinally extending recess 137 extending along the inner surface of seal spacer 133. Longitudinal passage 137 in turn communicates with control line flow passage 126 extending from the upper connection 121. Control fluid can thus communicate from radial port 135 through control fluid passage 126 to flow control line 30. A seal retainer 146 is located on the exterior of eccentric nipple 138 immediately above a second flow port or ports 150. The lower flow port 150 has a generally equivalent diameter to upper flow port 110.

The last member of annulus safety valve nipple assembly 12 is seal nipple 156 which is attached to eccentric nipple 138 by means of threaded connection 154. Seal nipple 156 has an internal seal bore 157 on its inner surface. Seal bores 73, 89, 106, 114 and 157 are all on the interior surface of nipple assembly 12 and are generally equivalent. Finally, seal nipple 156 is attached to workover string through a crossover sub member 172 by means of conventional threaded connections 168 and 186. It should be understood that this entire nipple assembly is incorporated into workover string 6 prior to its insertion into production tubing 2.

Nipple assembly 12 is incorporated into the workover string to provide a means of positioning and mounting annulus safety valve 10 within the workover string. Annulus safety valve 10 is mounted within nipple assembly 12 by means of a conventional lock member 42 and can be inserted and retrieved by conventional wireline techniques. Tubing safety valve 8 is positioned within workover string 6 in much the same manner. Lock member 42 is shown in FIG. 5. This lock comprises an inner shiftable collet 44 and an outer latching collet 48. Collet 44 is in the position shown in FIG. 1B. The outer latching collet is held outward in engagement with groove 50. By longitudinally shifting the inner collet, the outer latching collet may move inwardly to either release annulus safety valve 10 or to permit its insertion through the workover tubing string 6. Of course, in the position shown in FIG. 1B, lock member 42 serves to hold annulus safety valve 10 in place for operation.

Lock 42 is connected to the top of annulus safety valve 10 by means of threaded connection 56. Annulus safety valve top sub 58 is connected by means of conventional threaded connections to lock 42 at its upper end, to piston housing 76 on its lower outer end, and to inner mandrel 84 on its lower inner end. A conventional chevron sealing assembly or stack 68 is located between top sub member 58 and piston housing 76. This seal stack is positioned to engage seal bore 73 of landing nipple 52 in the assembled configuration. A longitudinally extending annular recess 79 is located along the outer surface of piston housing 76 for communication with control fluid port 72. The longitudinal extent of fluid passage 79 is sufficient to provide communication between port 72 and a radially extending port 78 located in piston housing 76. Piston housing 76 also has an O-ring seal located along its inner surface and a second conventional chevron sealing stack 81 along its outer surface. Chevron stack 81 is held in position by means of a lower seal retainer 86 also positioned along the outer surface of the piston housing engaging the piston housing by means of threaded connection 83. An axially movable piston 92 is located along the inner surface of piston housing 76 and is movable relative to piston housing 76. Piston 92 engages O-ring seal 82 below port 78 and also engages a second O-ring 75 located above port 78. O-ring seals 75 and 82 effectively seal an annular pressure chamber 80. A piston expansion chamber 69 is located above the upper surface of piston 92 and extends between piston housing 76 and inner mandrel 84. Piston 92 is longitudinally movable within expansion cavity 69. A helical spring 90 is located along the outer surface of piston 92 and abuts piston housing 76. A washer 88 is located between seal retainer 86 and spring 90. At the lower end of piston 92 spring 90 engages a lower seal retainer fixed relative to piston 90. Split ring 98 extends between seal retainer 96 and piston 92 to maintain these members in relatively fixed positions. Seal retainer 96 abuts the upper surface of a conventional chevron seal stack or packing unit 104 along the outer surface of lower valve mandrel 108. Lower valve mandrel 108 has an internal recess 107 on the interior thereof for engaging an external protrusion on inner mandrel 84. In the configuration shown in FIG. 1C, these shoulders are in abutment. The lower portion of valve mandrel 108 has a sealing or packing element 112 along its outer surface. As shown in FIG. 1C, this sealing element is in engagement with seal bore 114 on ported nipple 101. Inner mandrel 84 extends below lower valve mandrel 108 and at its lower end is connected by means of threaded connection 159 to seal mandrel 158. Seal mandrel 158 has another conventional sealing stack 160, also comprising chevron-shaped sealing elements. Set screw 157 extends between seal mandrel 158 and inner mandrel 84. A conventional O-ring sealing member 162 is also located between seal mandrel 158 and inner mandrel 84. A bottom sub 166 is attached to the lower end of seal mandrel 58, again by means of a conventional threaded connection. At the lower end of bottom sub 166 is an outwardly sloped conical surface 170.

Tubing safety valve 8, located immediately above annulus safety valve 10, is of conventional construction and is positioned within the nipple assemblies by conventional wireline techniques. A conventional valve which may be employed in this manner is more fully described on pages 774–775 of the Composite Catalog of Oil Field Equipment & Services for 1980–81, published by World Oil. A lock member 16, of conventional construction and similar to lock 42, is attached to the upper end of safety valve 8 and engages a cooperating groove 20 to mount valve 8 on conventional nipple 14. Sealing elements 22 and 32 are located on the outer surface of safety valve 8 and contact appropriate sealing surfaces on the interior of nipple member 14. When positioned, seals 22 and 32 are on opposite sides of control port 26 in nipple 14. In this position, the tubing mounted safety valve, which is operable under control line pressure from the surface, can be actuated by means of control fluid pressure exerted through port 26. As shown in FIG. 1A, tubing safety valve 8 has a rotating valve element 36 adjacent its lower end. A cylindrical flow passage 38 is located in valve element 36. Rotation of valve element 36 about an axis transverse to the valve element itself will result in opening and closing flow passage 38 relative to the central tubing passage of the workover string 6. As shown in FIG. 1A, this flow passage 38 extends transverse to the central flow passage of workover string 6 and would prevent flow therethrough from either above or below the safety valve 8.

Figure 4:
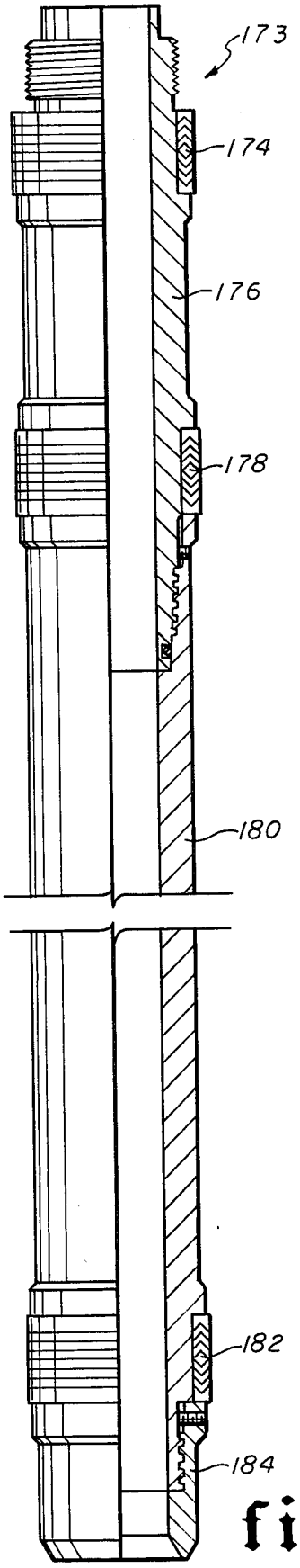
FIG. 4 depicts a separation sleeve used with the eccentric ported nipple shown in FIG. 3 after removal of the annulus safety valve.

If annulus safety valve 10 is removed from workover string 6, the annulus-to-tubing communication is isolated by inserting a separation sleeve 173. Separation sleeve 173, shown in FIG. 4, comprises first and second sealing or packing elements 174 and 178. Both of these sealing elements are located adjacent the upper end of separation sleeve 173. A third sealing member 182 is located along the lower end of separation sleeve 173. Each of these sealing members is attached to separation sleeve 173 in a conventional manner. The upper two sealing elements 174 and 178 will, when positioned, engage seal bores immediately above and immediately below landing nipple port 72. Lower sealing element 182 will engage a seal bore surface immediately below the lower flow port 150 to effectively seal the annulus after annulus safety valve 10 has been removed.

OPERATION

The safety valve assembly, depicted in the preferred embodiment of this invention, is intended for use as part of a workover string to be inserted within an existing production tubing string 2. This workover string will be used to stimulate the production zone of an oil well located below the position of the safety valve assembly. The preferred embodiment of this invention is specifically used to provide a means of artificially stimulating the production zone by means of artificial gas lift. Utilizing this configuration, the workover tubing string 6 may be inserted into the production tubing 2 and gas may be circulated through the center of workover string 6 to the production zone. By injecting gas through workover string 2, either intermittently or continuously, the gas will urge fluid from the formation up through the annulus between workover string 6 and production tubing string 2 to the surface. Not only can this gas lift technique be employed without the use of a completely new production string, but the safety valves required for this workover string can be activated utilizing existing control lines in the production tubing.

This workover string 6 may be positioned within existing production tubing provided there is an appropriate upwardly facing no-go shoulder 124 located on the production tubing 2 to allow the workover string 6 to be positioned relative to production string control line port 134. After workover string 6 has been inserted with no-go positioning shoulders 122 and 124 in abutment to properly locate the nipple assemblies relative to the control fluid port 134, the annulus safety valve may be inserted into workover string 6. Insertion of annular safety valve 10 in the workover string 6 is accomplished by conventional wireline techniques, with latch 48 engaging groove 50 to a position safety valve 10 relative to flow port 110. The tubing safety valve 8 can then be inserted, again by conventional wireline techniques, above annular safety valve 10. Lock 16 engages groove 20 in nipple 14 to appropriately position valve 8.

In the configuration shown in FIGS. 1A through 1D, both tubing valve 8 and annulus safety valve 10 are in closed positions. To open both the tubing and the annulus between workover string 6 and production string 4, control pressure must be appropriately applied to both valves 8 and 10. By applying control pressure, the tubing valve element 36 can be rotated to align flow passage 38 with the workover string tubing inner bore. Control pressure, when applied to annular safety valve 10, will cause piston 92 to move upwardly and will move axially reciprocal in order to lower valve mandrel 108 upwardly past flow port 110. This will permit communication between lower flow port 150 and upper flow port 110 through a bypass 118 in which mandrel 108 moves, thus providing communication through the annulus between workover string 6 and production tubing string 2 past the annulus safety valve 10. The arrows in FIGS. 1C and 1D indicate the direction of annulus flow when annulus safety valve 10 is open. Note, however, that the valve itself is shown in the closed position in FIGS. 1C and 1D. Movement of seals 112 upwardly past port 110 will permit flow in the direction of the arrows.

The control line pressure needed to activate both valve 8 and valve 10 can be provided by using existing control line 128 located on the exterior of production string 2. As shown in FIG. 1, control line 128 communicates through port 134 with fluid passage 126 in eccentric nipple 138. Control fluid, in turn, communicates with control line 30 extending from eccentric nipple 138 to control block 70 on the exterior of landing nipple 52. Control line 30 continues upwardly from control block 70 to control block 28 where control fluid can be applied to the tubing safety valve 8 through port 26. Control fluid pressure exerted through port 26 will activate tubing safety valve 8 in a conventional manner. The same control line pressure acting on tubing safety valve 8 will also act on annulus safety valve since control fluid can pass through port 72 in landing nipple 52 and thence along longitudinal annular cavity 79 to radial port 78 in piston housing 76. Control fluid pressure exerted through port 78 will cause piston 92 to move relatively upward, thus expanding annular piston chamber 80 while piston 92 moves upwardly within expansion chamber 69. As piston 92 moves up under the influence of control line pressure, the lower valve mandrel 108 is drawn upwardly to open port 110. In this manner, control line pressure exerted through the existing production string control lines can be used to actuate both tubing valve 8 and annulus safety valve 10. As with conventional subsurface mounted control safety valves, any interruption in control line pressure will cause both tubing safety valve 8 and annulus safety valve 10 to close, thus effectively sealing the production tubing 2.

Although the invention has been described in terms of the specified embodiment which is set forth in detail, it should be understood that this is by illustration only and that this invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for use in injecting material through an inner conduit to the formation in a subterranean well, such as the injection of gas to provide artifical lift to the formation, with fluids being produced through the annulus between the inner conduit and an existing outer conduit, such as a production tubing string, which has an external source of control fluid associated therewith, said apparatus comprising:

nipple means incorporable in said inner conduit and insertable within the outer conduit, said nipple means for establishing communication with said external control fluid line associated with the outer conduit, and extending to the well surface, means for establishing sealing integrity at a position between said inner conduit and said outer conduit, bypass ports on opposite sides of said sealing means, and means for positioning said nipple means relative to said outer conduit to establish control fluid communication and sealing integrity between said inner and outer conduits;

annulus safety valve means mountable on said nipple means relative to said outer conduit to establish control fluid communication and sealing integrity between said inner and outer conduits;

annulus safety valve means mountable on said nipple means and movable from a first position closing the annulus between said inner and outer conduits to a second position opening said annulus when subjected to control fluid pressure;

tubing safety valve means mountable on said nipple means and movable from a first position closing said inner conduit to a second position opening said inner conduit when subjected to control fluid pressure; and an axially extending control line extending within said annulus between said annulus safety valve means and said tubing safety valve means attachable to said nipple means and communicable through said nipple means with said external control fluid pressure line and communicable with said annulus safety valve and said tubing safety valve.

2. The apparatus of claim 1 wherein said annulus safety valve closes bypass ports on one side of said seal means when in said first position.

3. The apparatus of claim 2 wherein said nipple means further comprises means on the interior thereof for locating said annulus safety valve means in position to open and close bypass ports on one side of said seal means.

4. The apparatus of claim 3 wherein said means for locating said annulus safety valve means comprises a groove axially spaced from said bypass ports.

5. The apparatus of claim 1 wherein said means for positioning said nipple means relative to said outer conduit comprises a downwardly facing radially outwardly extending shoulder for engaging said outer conduit.

6. The apparatus of claim 1 wherein said annulus safety valve means comprises seal means for engaging said nipple means above and below said bypass ports to prevent flow in said annulus and through said bypass ports from entering said inner conduit.

7. The apparatus of claim 1 wherein said control line extends from said nipple means to said annulus safety valve means and thence to said tubing safety valve means.

8. The apparatus of claim 1 wherein said means for establishing sealing integrity between said inner conduit and said outer conduit comprises first and second axially spaced seal members.

9. The apparatus of claim 8 wherein said means for establishing communication with said external source of control fluid comprises a fluid passage extending through said nipple means and between said first and second seal members.

10. The apparatus of claim 1 wherein said annulus safety valve and said tubing safety valve are insertable within the nipple means.

11. A method of injecting a material, such as gas to provide artificial lift to the formation of a subterranean well, through a production tubing string extending to the formation and having an external control fluid pressure line associated therewith, and producing fluids through the production string while maintaining control over the flow in said production tubing, comprising the steps of:

inserting a workover tubing string through the production string, the workover string having a nipple incorporated therein for establishing communication with the external control fluid pressure line, and axially spaced ports extending therethrough;

sealing the annulus between the workover tubing string and the production tubing string at a position between said axially spaced ports;

positioning an annulus safety valve on the interior of said workover tubing string having an axially extending bypass between said axially spaced ports and a mandrel movable in said bypass to close said bypass, and opening at least one of said ports in response to control fluid pressure;

injecting said material through the workover tubing string to cause produced fluids to flow upward in the annulus between the workover tubing string and the production tubing string; and increasing the control fluid pressure in said external control pressure line acting on said mandrel to open said ports to permit said produced fluids to flow to the surface of the subterranean well.

12. A surface controlled safety valve apparatus for use in a subterranean well to control the flow in an inner conduit and in the annulus between the inner and outer conduit having an external control fluid pressure line extending to the well surface associated therewith, comprising:

a first safety valve means mountable on the interior of said inner conduit and movable under control fluid pressure from a closed to an open position for allowing flow through said inner conduit when in the open position;

a second safety valve means mountable on the interior of said inner conduit and movable under control fluid pressure from a closed to an open position for allowing flow through said annulus between said inner and outer conduit when in the open position;

a common control fluid line extending between said first and second valve means with control fluid pressure within said common control fluid line means acting on said first and second safety valve means;

first and second seal means extending across the annulus between said inner and said outer conduit;

bypass ports in said inner conduit on opposite sides of said seal means, said first and second seal means being between said bypass ports;

a control fluid passage extending between said first and second seal means; and, means for positioning said control fluid passage in communication with said external control fluid pressure line associated with the outer conduit.

13. The apparatus of claim 12 wherein said common control line extends from said first to said second safety valve means, with said second safety valve means being between said first safety valve means and said control fluid passage.

14. A surface controlled safety valve apparatus for use in a subterranean well to control the flow in the annulus between an inner and outer conduit having an external control fluid pressure line extending to the well surface associated therewith, comprising:

nipple means incorporable in said inner conduit for establishing communication with said external control fluid pressure line;

seal means for establishing sealing integrity between said inner and outer conduits and comprising first and second axially spaced seal members located on said nipple means;

ports extending through said inner conduit above and below said seal means to permit flow within said inner conduit bypassing said seal means;

a valve mountable on the interior of said inner conduit and having an axially reciprocal mandrel movable under control line pressure from a first position in which all ports on one side of said seal means are closed to a second position in which said ports are open;

a control line extending from said nipple means to said valve; and a control fluid passage extending between said first and second seal members for establishing communication with said external source of control fluid pressure.

15. An apparatus for use in injecting material to provide artificial lift to the formation of a subterranean well, through a production tubing string extending to the formation and having an external control fluid pressure line associated therewith, fluids being produced through the production tubing string, comprising:

an inner tubing string insertable through the production string;

a nipple incorporated in said inner tubing string and insertable within the production string having means for establishing communication with the external control fluid pressure line associated with the production string;

sealing means on said inner tubing string for establishing sealing integrity between said inner and outer conduit;

bypass ports on opposite sides of said sealing means;

annulus safety valve means mountable on said production tubing string and movable from a first position closing the annulus between said inner and outer conduits to a second position opening said annulus when subjected to control fluid pressure;

tubing safety valve means mountable on said production tubing string and movable from a first position closing said inner conduit to a second position opening said inner conduit when subjected to control fluid pressure; and an axially extending control line on the nipple means extending within said annlus and communicable through said nipple means with said external pressure line associated with the production string and communicable with said annulus safety valve and said tubing safety valve.

* * * * *